US006543070B2

(12) United States Patent
Longenecker et al.

(10) Patent No.: US 6,543,070 B2
(45) Date of Patent: Apr. 8, 2003

(54) PLAYARD AND A CHANGING TABLE THEREOF

(75) Inventors: Michael L. Longenecker, Ephrata, PA (US); Jason D. Covill, Reamstown, PA (US)

(73) Assignee: Graco Children's Products Inc., Exton, PA (US)

( * ) Notice: Subject to any disclaimer, the term of this patent is extended or adjusted under 35 U.S.C. 154(b) by 55 days.

(21) Appl. No.: 09/850,164

(22) Filed: May 8, 2001

(65) Prior Publication Data

US 2002/0166169 A1 Nov. 14, 2002

(51) Int. Cl.[7] ..... A47D 7/04

(52) U.S. Cl. ..... 5/93.1; 5/655; 5/99.1; 5/97

(58) Field of Search ..... 5/93.1, 94, 97, 5/99.1, 655

(56) References Cited

U.S. PATENT DOCUMENTS 4,694,516 A * 9/1987 Overman et al. ..... 5/113
5,349,709 A * 9/1994 Cheng ..... 5/93.1
5,381,570 A 1/1995 Cheng
5,918,329 A * 7/1999 Huang ..... 5/503.1
6,173,462 B1 * 1/2001 Huang et al. ..... 5/507.1
6,233,759 B1 * 5/2001 Warner et al. ..... 5/93.1

FOREIGN PATENT DOCUMENTS

GB 221080 9/1924

* cited by examiner

*Primary Examiner*—Michael F. Trettel
(74) *Attorney, Agent, or Firm*—Foley & Lardner

(57) ABSTRACT

A playard includes a changing table. The changing table includes two arm assemblies and first and second rails connected therebetween. Each arm assembly has a pivot arm and a folding arm pivotally attached to the pivot arm. The pivot arms are attachable to upper side rail members of the playard. The pivot arms are connected to the first rail and the folding arms are connected to the second rail. The folding arms are pivotal about the pivot arms so that the changing table is movable between an open position in which the second rail is positioned away from the first rail and a closed position in which the second rail is positioned adjacent to the first rail.

27 Claims, 13 Drawing Sheets

PLAYARD AND A CHANGING TABLE THEREOF

BACKGROUND OF THE INVENTION

This invention relates to a playard and a changing table thereof. An exemplary playard apparatus is described in U.S. Pat. No. 5,381,570 to Cheng, which is incorporated herein by reference.

Changing tables for playards are known in the prior art. A user can change a child's diaper or perform other child-related tasks on a changing table that can be mounted to the top of a playard. The changing table, which is generally rectangular in shape, can be supported on three sides by three upper frame supports of the playard. After the child's diaper has been changed, the changing table can be completely removed from the playard, or, in some embodiments, can be swung about an upper frame support of the playard to a storage position exterior of the playard. In this regard, the user can lift the side of the changing table opposite the upper frame support and can swing the table about the upper frame support to its storage position at an exterior side of the playard. The changing table then can rest in its storage position exterior of the playard.

As seen in FIG. 7, conventional changing tables 12 have a disadvantage in that, if the playard 10 is positioned adjacent a wall, when the changing table 12 is swung to its storage position, the changing table 12 will only swing away from the interior of the playard until it comes into contact with the wall. Accordingly, to remove the changing table 12, the playard 10 has to be moved sufficiently far away from the wall so that there is sufficient clearance between the wall and the side of the playard 10 to allow for passage of the changing table 12. Consequently, this conventional playard 10 and changing table 12 combination may be inconvenient to use when the playard 10 is placed in a space-restricted location, such as in a small apartment or small room.

Furthermore, because the conventional changing table 12 protrudes from the side of the playard when stored, and because the playard often is stored with the changing table attached to it, the playard requires sizeable storage space. With the rapidly rising cost of housing and real estate, there is a need for improving the space utilization of existing living and storage space, while providing the convenience of a playard with an attached changing table that can be used without the burdensome steps of assembly or disassembly.

Another disadvantage with the above-described conventional playard and changing table products is that the products are inconvenient to transport. For those products where the changing table can be completely removed from the playard, the products require the transport of two separate pieces that then have to be assembled together during use. Moreover, one of the two pieces may be lost or forgotten if, for example, they are stored by the user in different places. For those products where the changing table is attached to the playard and swings about an upper frame support to its storage position, greater storage space is required, as discussed above, which becomes an even more acute concern during transport since storage space during transport is often more restricted. Therefore, conventional playard and changing table products do not make the most effective utilization of living and storage space and are inconvenient to transport.

SUMMARY OF THE INVENTION

The present invention relates to a playard and a changing table thereof. The playard can include an upper end rail member and a pair of upper side rail members, and a changing table.

The changing table can include first and second rails and a pair (first and second) of arm assemblies. Each of the arm assemblies can include a (first, second) pivot arm and a (first, second) folding arm pivotally connected the respective pivot arm. The first rail can be connected between the first and second pivot arms. The second rail can be connected to the first and second folding arms so that the folding arms together with the second rail are movable between an open position in which the second rail is positioned away from the first rail and a closed position in which the second rail is positioned adjacent to the first rail.

In particular, the ends of the first rail can be connected proximate to outer ends of the pivot arms, and the ends of the second rail can be connected proximate to outer ends of the folding arms. The pivot arms can be pivotally connected to the respective folding arms.

The first folding arm can be pivotally connected to the first pivot arm at a first pivot joint, and the second folding arm can be pivotally connected to the second pivot arm at a second pivot joint. In this respect, the changing table can further include a locking mechanism for locking at least one of the first and second pivot joints to lock the first and second folding arms in at least one of the open position, the closed position, and an intermediate position between the open and closed positions.

The changing table can further include a platform attached to the first rail and the second rail. The platform can be a flexible material and can include a pouch on a bottom surface thereof for receiving a removable board. The flexible platform can be positioned outside of (exterior of) the playard when the changing table is in the closed position. Moreover, the flexible platform can drape over the first end of the playard when the changing table is in the closed position.

The length of each of the first and second folding arms can be substantially equal to or slightly greater than the length of the respective first and second pivot arms. In this respect, the second rail can extend beyond an end frame support of the playard when the folding table is in the closed position.

The first and second pivot arms can be attached to the side rail members of the playard. Moreover, changing table can include a bracket for attaching the first rail to the end rail member. The first and second folding arms also can lie substantially over the upper side rail members when the folding table is in the open position. Moreover, the first and second pivot arms can be substantially parallel to each other, and the first and second folding arms can be substantially parallel to each other.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION

Figure 1:
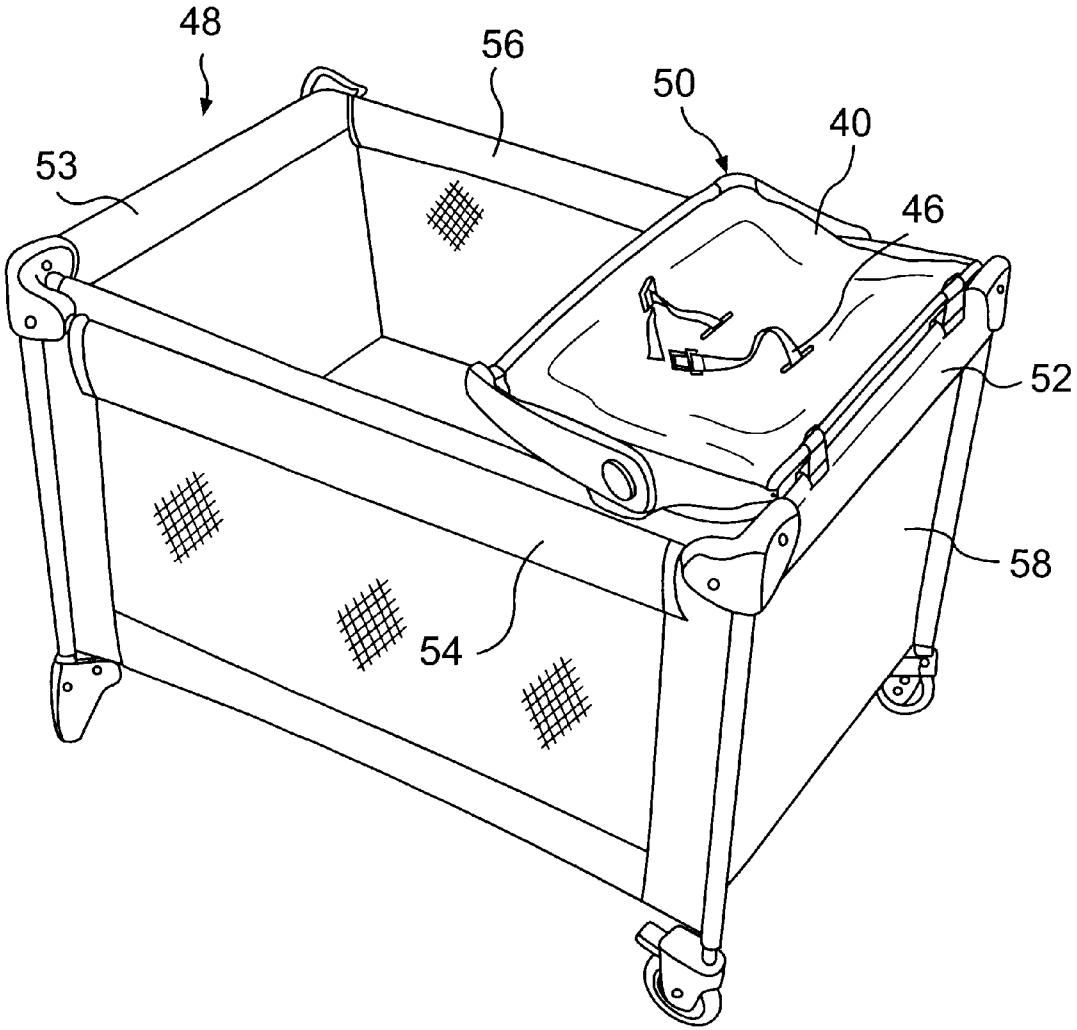
FIG. 1 is a perspective view of a playard with a changing table in accordance with one preferred embodiment of the present invention.

Referring to the figures, wherein like numerals indicate like parts, and particularly to FIG. 1, a playard 48 is shown with a changing table 50 mounted thereto in accordance with the invention. The playard 48 itself can be any conventional playard or frame having an least one upper end rail member 52 and a pair of upper side rail members 54, 56. The upper side rail members 54, 56 typically are connected to the end rail member 52 and other structural members, such as legs, corner pieces, etc.

Figure 2:
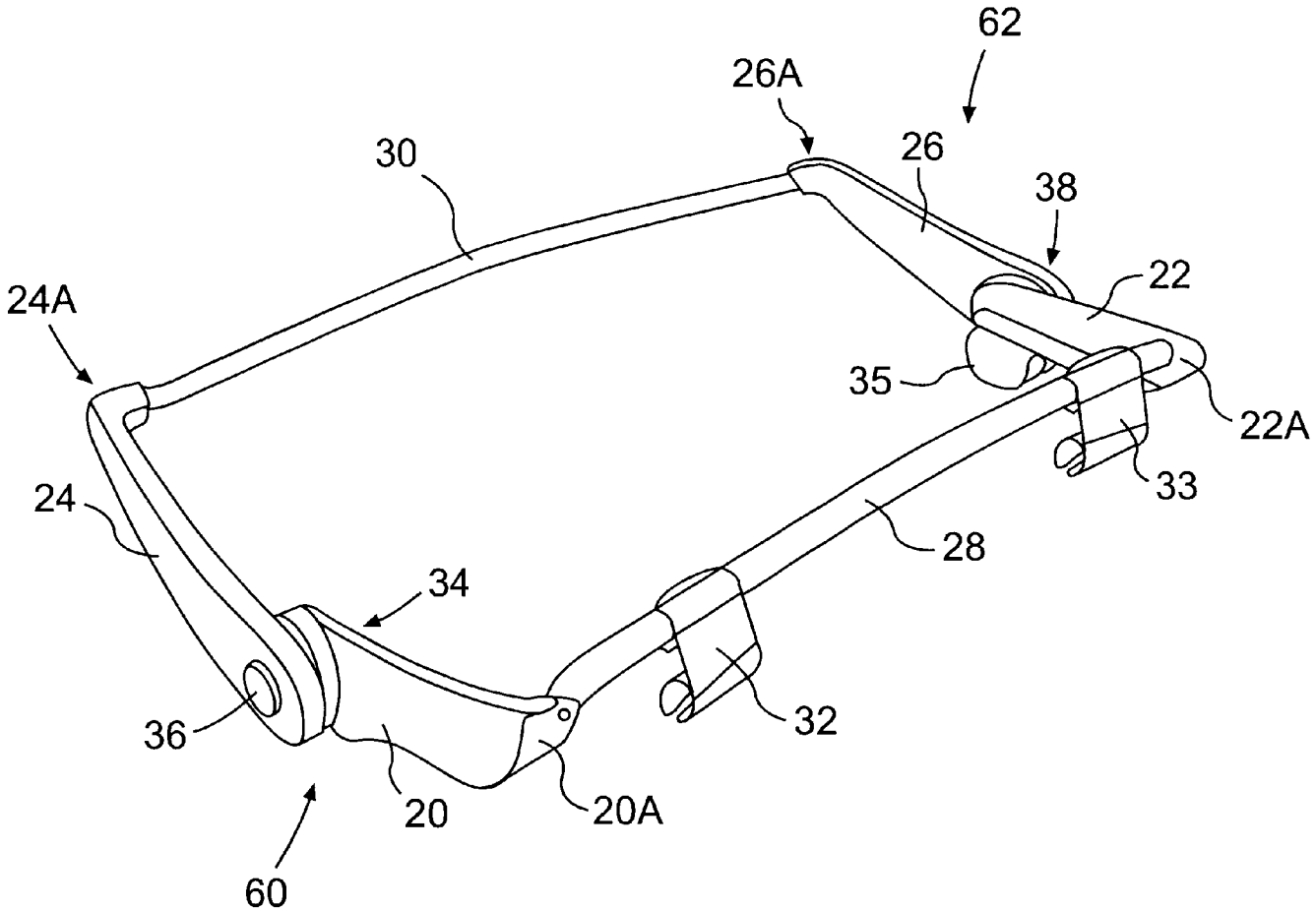
FIG. 2 is a perspective view of the frame of the changing table without a platform.

Referring to FIGS. 1 and 2, the changing table 50 for a playard 48 includes first and second rails 28, 30 and two (first, second) arm assemblies 60, 62. The arm assemblies 60, 62 each include a pivot arm 20, 22 and a folding arm 24, 26 pivotally connected to the respective pivot arm 20, 22 by, for example, a pivot joint 36, 38. Each pivot arm 20, 22 is connected at or proximate one (outer) end 20A, 22A to the first rail 28 and pivotally connected at or proximate the other (pivot) end to the first and second folding arms 24, 26, such as at pivot joint 36, 38. The other (outer) ends 24A, 26A of the folding arms 24, 26 are attached to the second rail 30, which extends between the two folding arms 24, 26. The first rail 28 extends between the first and second pivot arms 20, 22. The folding arms 24, 26 can pivot about the respective pivot joints 36, 38 so that the folding arms 24, 26, along with the second rail 30 attached thereto, are movable or pivotal between an open position, in which the second rail 30 is positioned away from the first rail 28 (see FIG. 3A), and a closed position, in which the second rail 30 is positioned adjacent to the first rail 28 (see FIG. 3C).

Figure 4:
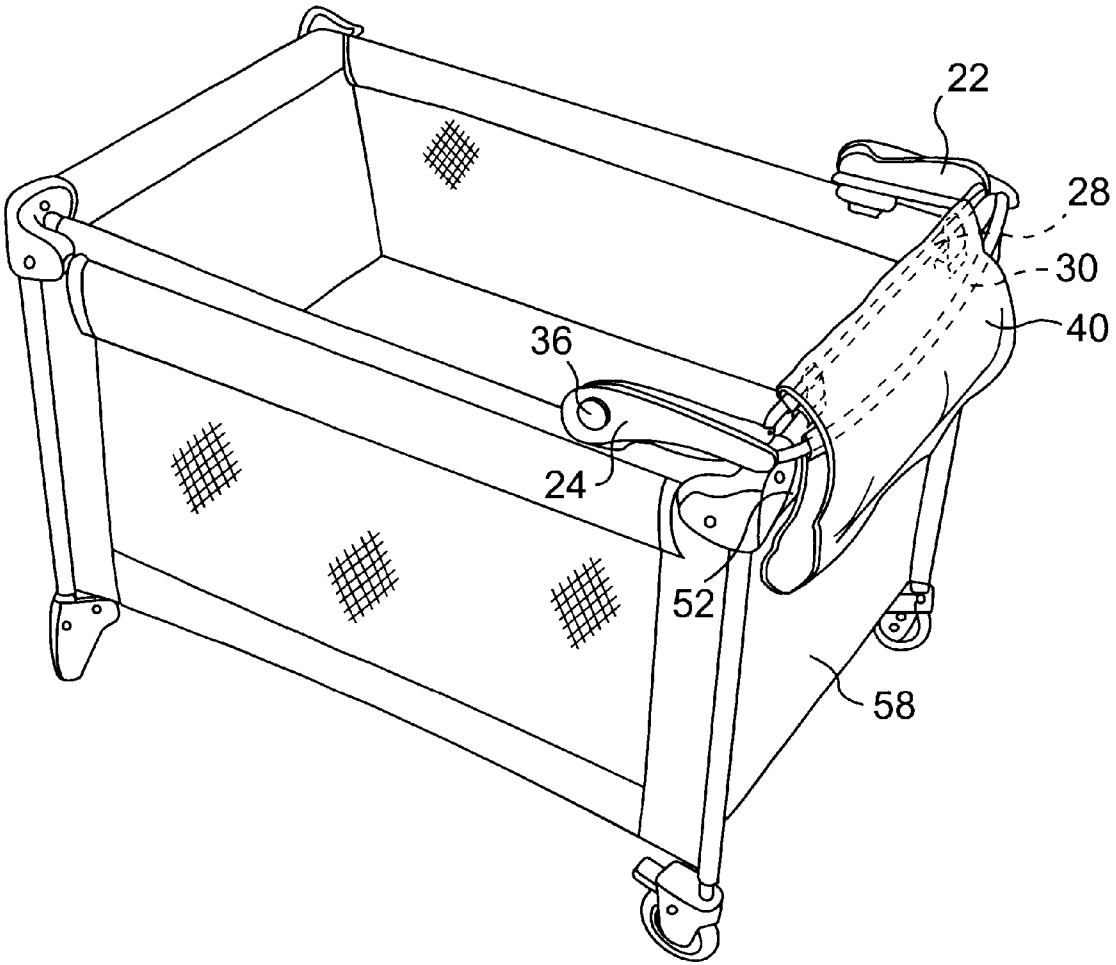
FIG. 4 is a perspective view of the apparatus in FIG. 3C with the platform attached to the changing table frame in the closed position.
Figure 5:
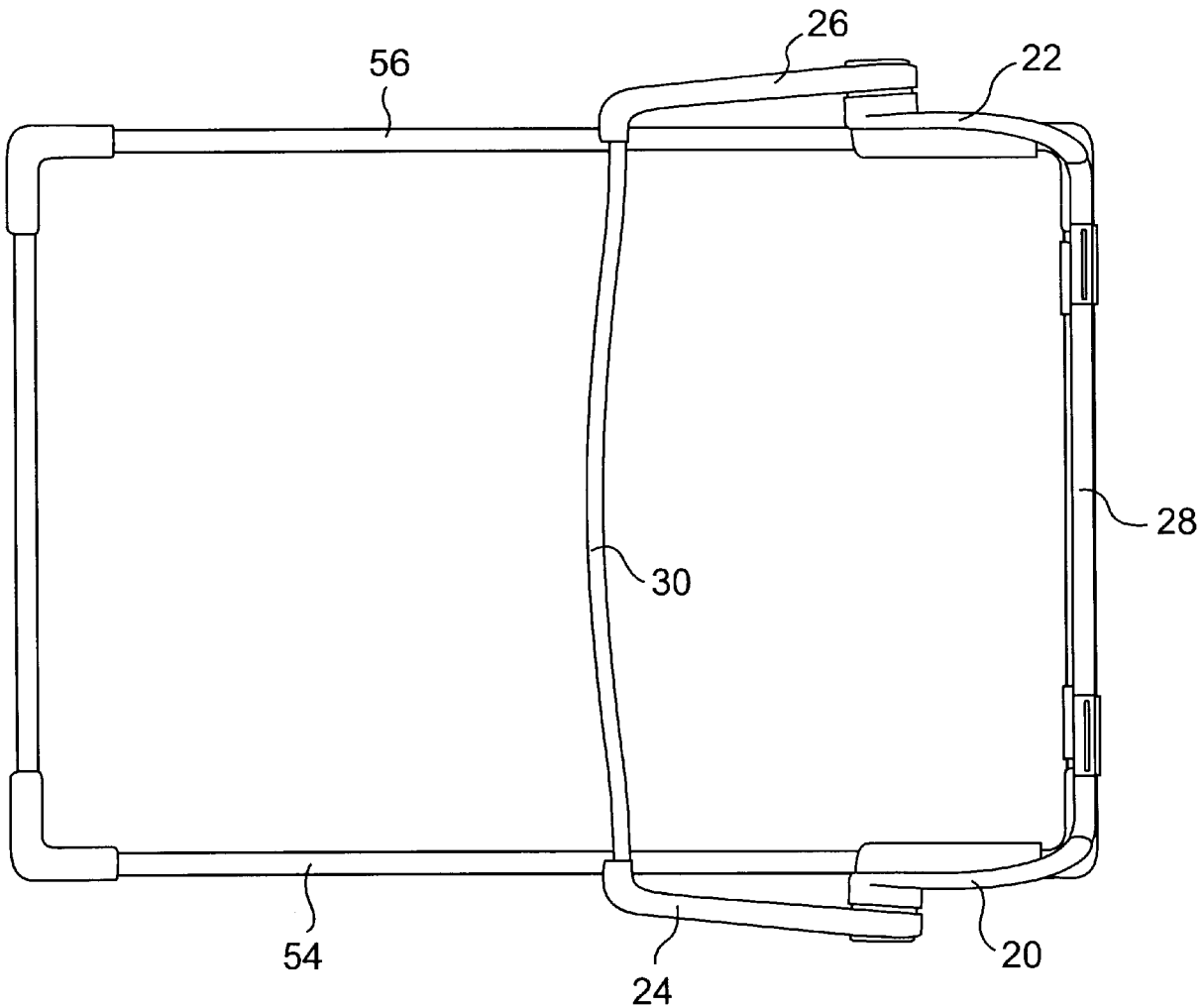
FIG. 5 is a top plan view of a playard with the changing table frame.

The folding arms 24, 26 can be substantially parallel to each other, as can the pivot arms 20, 22, as shown in FIGS. 2 and 5. The folding arms 24, 26 each can be longer than their respective pivot arms 20, 22 so that, as shown in FIG. 3C, the second rail 30 extends slightly beyond the first rail 28 and the end rail member 52 when the changing table 50 is folded (i.e., in the closed position). That is, the distance from the pivot center of the pivot joint 36, 38 to the outer end 24A, 26A of the folding arm 24, 26 is greater than the distance from the pivot center to the outer end 20A, 22A of the pivot arm 20, 22. In the embodiment of FIGS. 1–5, the second rail 30 extends outwardly from the end rail member 52 of the playard 48 when the changing table 50 is in the closed position. Alternatively, the respective distances can be made about the same so that the second rail 30 hovers over the end rail member 52. In addition, if desired, the second rail 30 can be formed with a sufficient curvature so that it extends beyond the upper end rail member 52 of the playard 48 when the changing table 50 is in the closed position. This allows the flexible platform 40 to fold and drape outside the playard 48 when the changing table is in the closed position.

According to the present invention, brackets, clips, straps, or other attachment structures can be provided on the first rail 28 and/or one or both of the pivot arms 24, 26 to attach the changing table 50 to the playard 48. For example, each of the first and second pivot arms 20, 22 can include an arm bracket 34, 35 for connection to the respective upper side rail members 54, 56 of the playard to secure the pivot arms 20, 22 to the upper side rail members 54, 56. The brackets 34, 35 can be connected to the side rail members 54, 56 in a snap fit, for example, as discussed below in connection with FIGS. 10 and 11. Further, the folding arms 24, 26 can include end brackets 37, 39 having a grooved face that rests atop the respective side rail members 54, 56, as seen, for example, in the embodiment of FIGS. 8 and 9. Alternatively, the folding arms 24, 26 need not have brackets and, instead, can be supported in position over the side rail members 54, 56 by the pivot joint 36, 38 and arm brackets 34, 35, as shown, for example, in FIGS. 1 and 3A. In addition to the brackets for the arm assemblies 60, 62 discussed above, the playard 48 can include two rail brackets 32, 33 or other conventional attachments to attach the first rail 28 of the changing table 50 to the end rail member 52 of the playard 48, as shown, for example, in FIGS. 1–5. These bracket arrangements are merely representative, and other bracket arrangements can be envisioned to secure the changing table 50 to one or more of the playard rail members 52, 54, 56.

Alternative embodiments for connecting changing table 50 to playard 48 and for supporting arm assemblies 60, 62 will be apparent to one skilled in the art, and the embodiments disclosed herein are not meant to limit the invention. For example, one skilled in the art would recognize that the first rail 28 could also be attached to one of the side rails 54, 56 of the playard 48 so that the changing table could fold over the respective side of the playard 48. In addition, while the first rail 28 can be attached to the end rail member 52 of playard 48, as in the embodiment of FIGS. 1–5, one skilled in the art would recognize that first rail 28 could also be attached to some other structure of end frame side 58 or some other object proximate to end rail 52, instead of to end rail 52 itself. Furthermore, in the illustrated embodiments, the bracket connections are designed to be detachable from the playard 48 sot that the changing table 50 can be removed from the playard 48 at the user's convenience. Alternatively, however, the changing table 50 can be permanently attached to the playard 48 even when not in use. Such permanent attachment would not be inconvenient since the changing table 50 can be folded over into a closed position that requires little storage space.

As shown in FIG. 1, a platform 40 can be attached at one end to first rail 28 and at the other end to second rail 30 to form the changing table surface. The platform 40 can be made of a flexible (i.e., foldable) material, such as cloth or plastic. As the changing table 50 moves from its open position (see FIG. 3A) to an intermediate position (see FIG.

3B) to its closed position (FIG. 3C), the platform 40 moves away from the interior of the playard 48 to a position substantially exterior of the playard 48. When the changing table 50 is in the closed position, the platform 40 drapes outside of the playard 48 and is substantially parallel to the end frame side 58, as shown in FIG. 4. By using a platform 40 made of a flexible material, the platform 40 can be made to rest outside the playard 48 in the closed position of the changing table 50, while the two ends of the platform 40 remain connected to the first rail 28 and the second rail 30, respectively. A safety belt 46, shown in FIG. 1, may also be attached to platform 40 to help restrain a child, for example, while changing a diaper.

As best seen in FIG. 4, in one embodiment, the second rail 30 extends slightly beyond the first rail 28 and the end rail member 52 so that, when the changing table 50 is in the closed position, the platform 40 can be draped over the end rail 52. This substantially positions the platform outside the end frame side 58 of the playard 48. The platform 40 remains attached at either end to the first rail 28 and the second rail 30, respectively. In an alternative embodiment, the changing table 50 can be dimensioned so that the second rail 30 does not extend out beyond the end rail member 52, yet the second rail 30 is sufficiently close to the end rail member 52 so that the platform 40 can be draped over end rail member 52. Further, it will be apparent to one skilled in the art that, when the changing table 50 is in the closed position, the platform 40 need not be substantially parallel to the end frame side 58. In addition, if the end frame side 58 of the playard is not perpendicular to the ground, i.e., if it slants or curves with respect to the ground, the platform 40 can follow the slant or curve of the end frame side 58.

Figure 9:
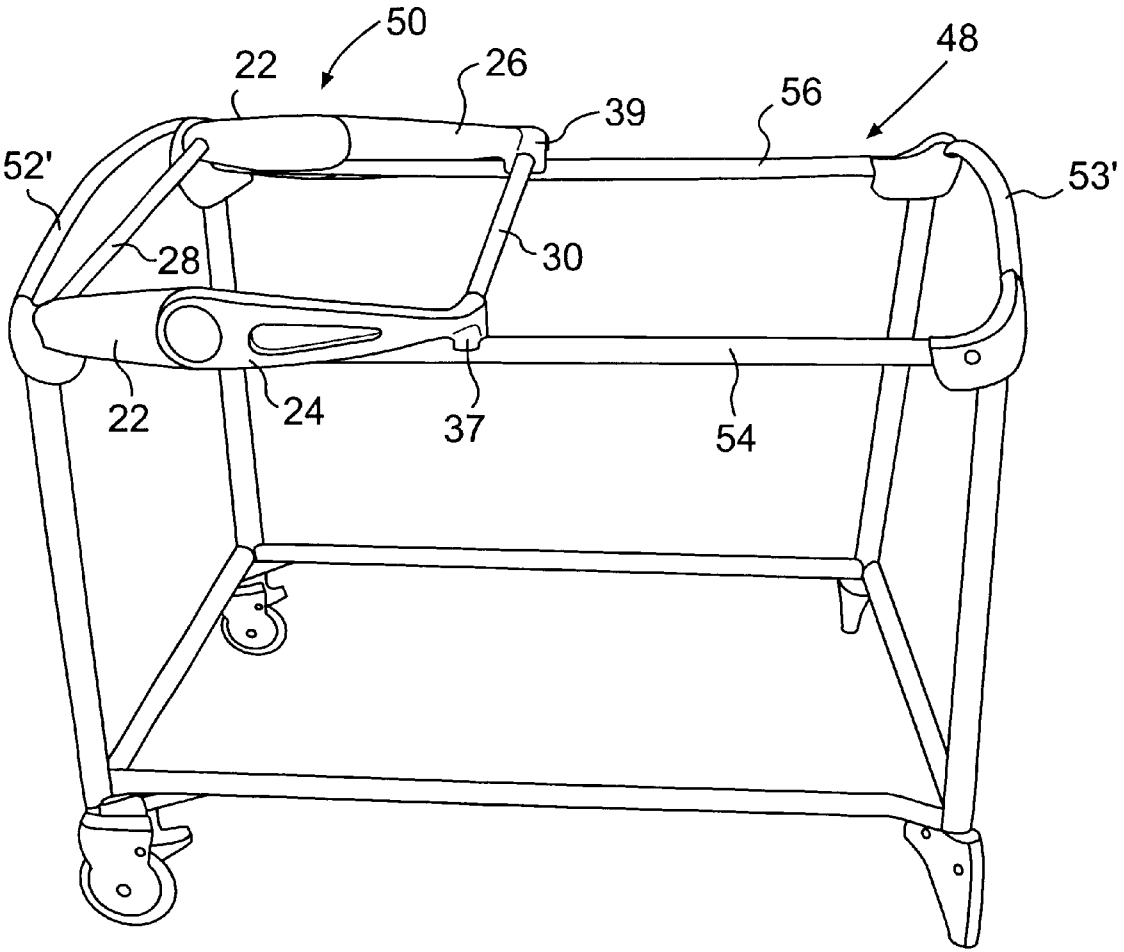
FIG. 9 is a perspective view of the frame of a playard with a frame of the changing table according to still another preferred embodiment of the present invention.
Figure 10:
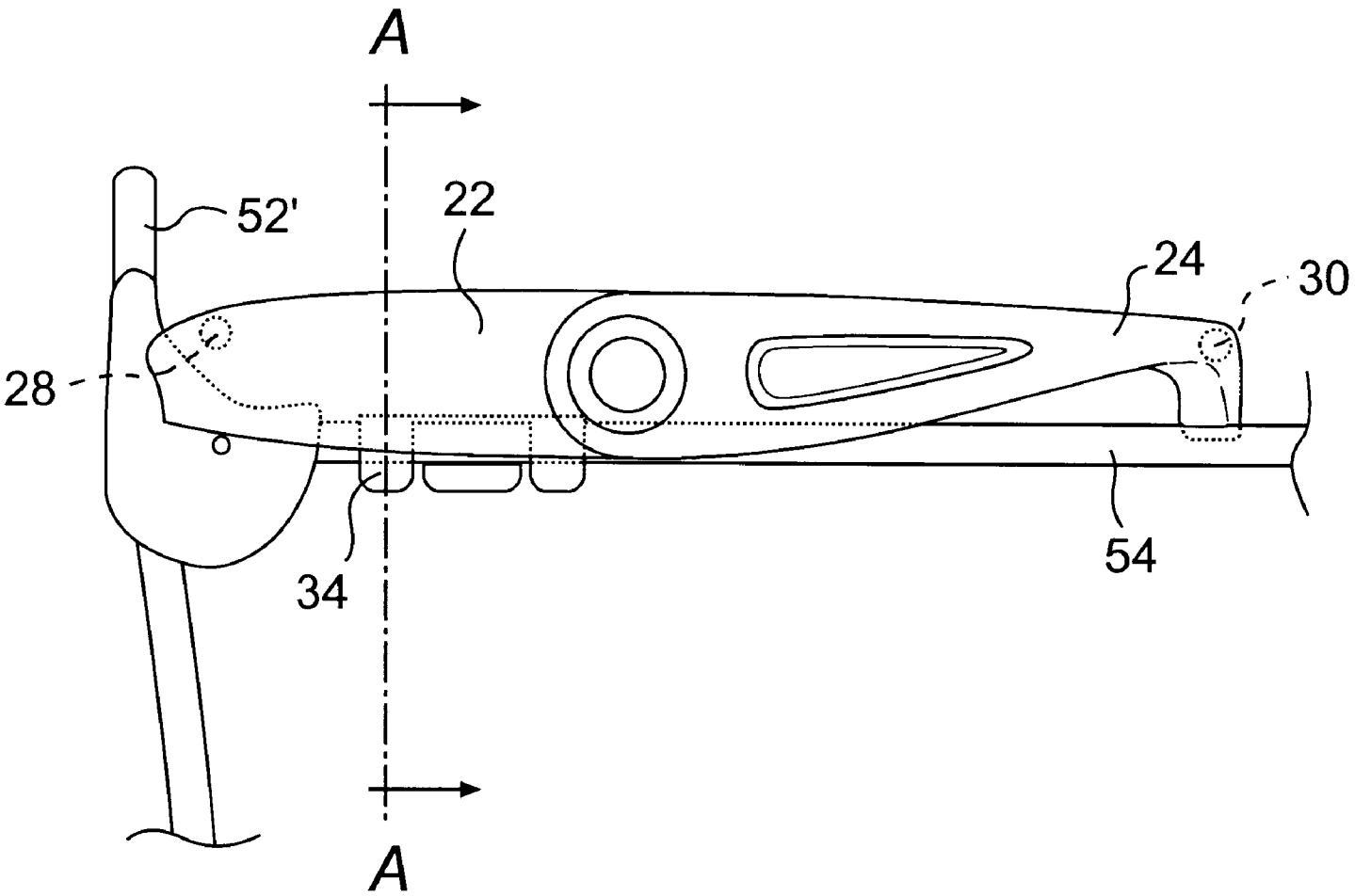
FIG. 10 is a side view of one embodiment of the arm assembly of the changing table connected to an upper side rail of the playard.
Figure 11:
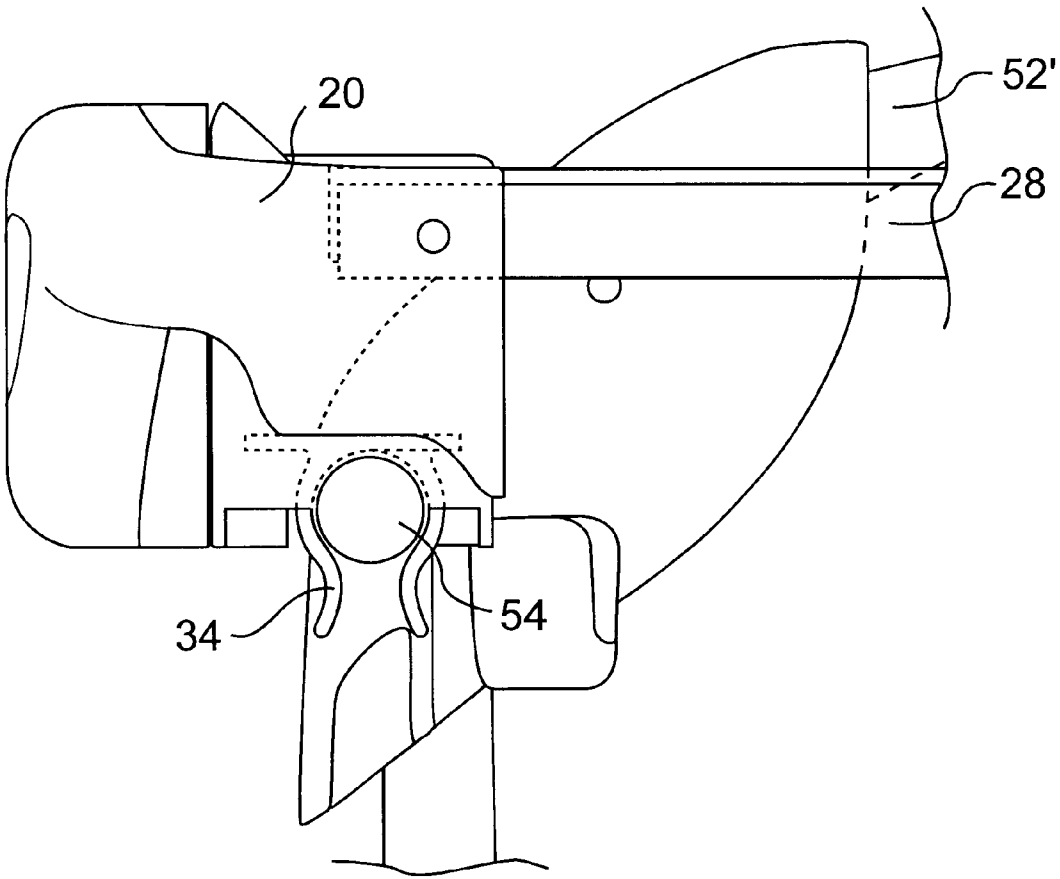
FIG. 11 is sectional view along section A—A of FIG. 10.

FIGS. 9–11 show another embodiment of the present invention. Referring to FIG. 9, the upper end rail 52' of the playard 48 can be arched such that the first rail 28 of the changing table 50 is positioned proximate to, but below, the upper end rail 52' of the playard 48. In this embodiment, when the changing table 50 is in a closed position, the second rail 30 is proximate the upper end rail 52' and the first rail 28. In the closed position, the platform (not shown in FIG. 9), which is connected between the first and second rails 28, 30, preferably drapes over the upper end rail 52' so that the platform is positioned substantially outside the playard 48. Alternatively, however, the platform can be positioned inside the playard 48 when the changing table 50 is in the closed position, for example, by being draped downward proximate one of the end face of the playard 48.

FIGS. 10 and 11 show an exemplary attachment of the pivot arm 20 to one of the upper side rails 54 of the playard 48 in accordance with the embodiment shown in FIG. 9. As seen in FIG. 10, the pivot arm 24 includes bracket 34 that snaps on and attaches to the upper side rail 54 of the playard 48. A possible shape of bracket 34 and its attachment to the upper side rail 54 of the playard 48 can be seen in FIG. 11, which is a sectional view along section A—A of FIG. 10. It should be noted that the shape and number of bracket(s) shown are exemplary only, and other such brackets may also be used to provide the requisite attachment. The first end rail 28 of the changing table 50 is not and need not be attached to the upper end rail 52' of the playard 48; rather, it is positioned below the curved (or arched) upper end rail 52'. A similar snap-on bracket or brackets can be provided to attach pivot arm 22 to the opposite upper side rail 56 of the playard 48.

The changing table 50 can include a locking mechanism (not shown) that locks pivot joints 36, 38 so that the folding arms 24, 26 can be locked at one or more of the open position, the closed position, and an intermediate position between the open and closed positions. The structure of the optional locking mechanism is not discussed in detail herein since implementing such a locking mechanism is within the abilities of one skilled in the art.

Figure 3A:
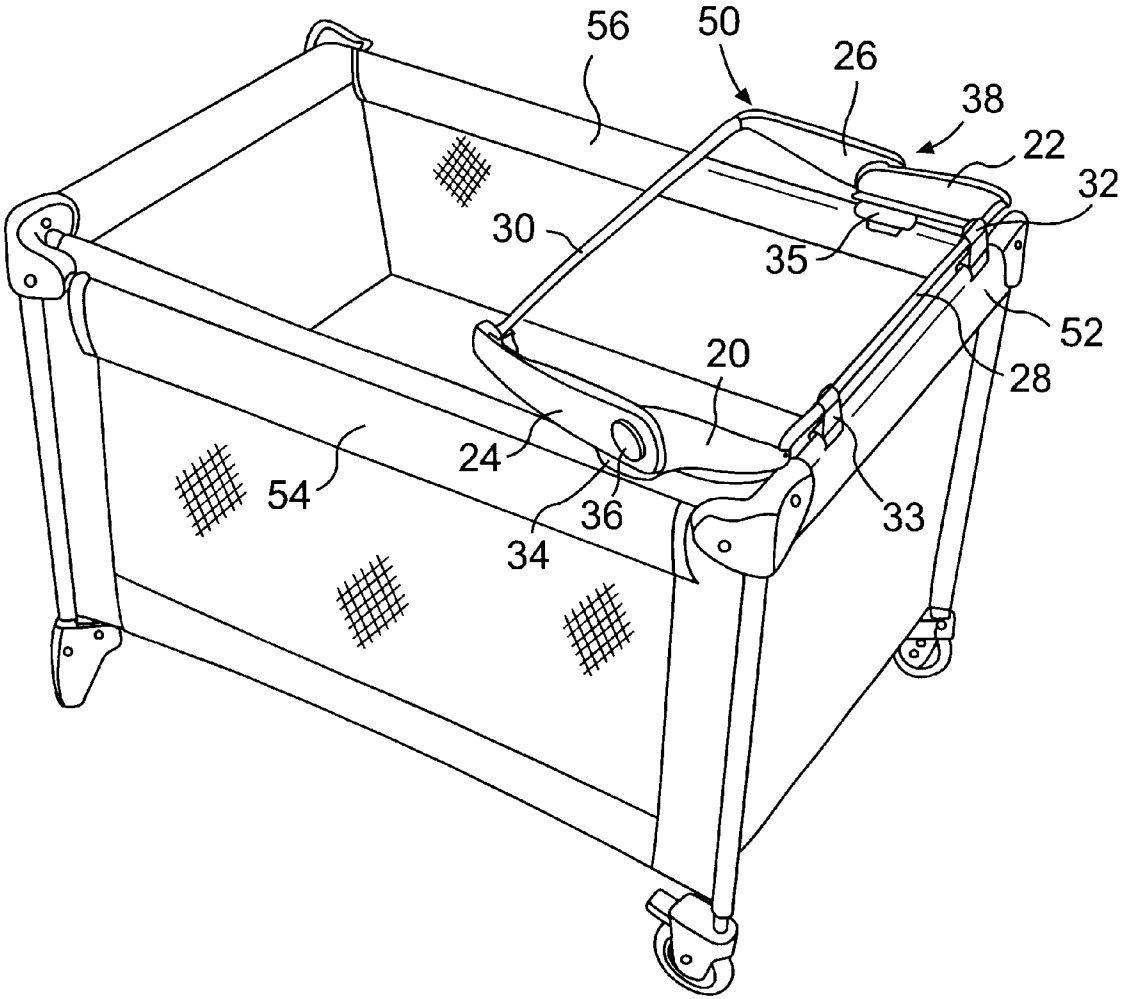
FIG. 3A is a perspective view of a playard with the changing table frame in an open position.
Figure 3B:
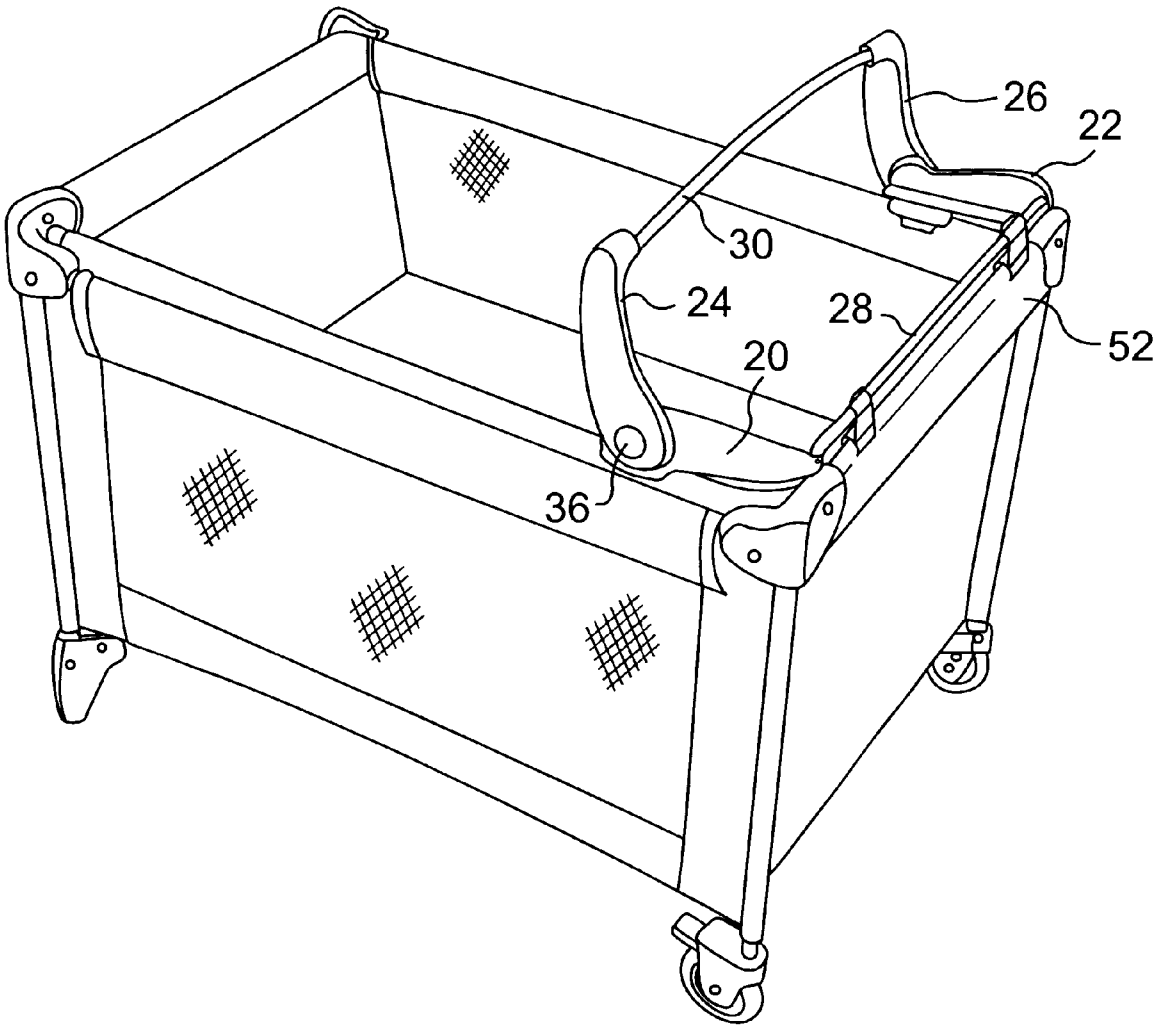
FIG. 3B is a perspective view of the apparatus in FIG. 3A with the changing table frame in an intermediate, partially open position.
Figure 3C:
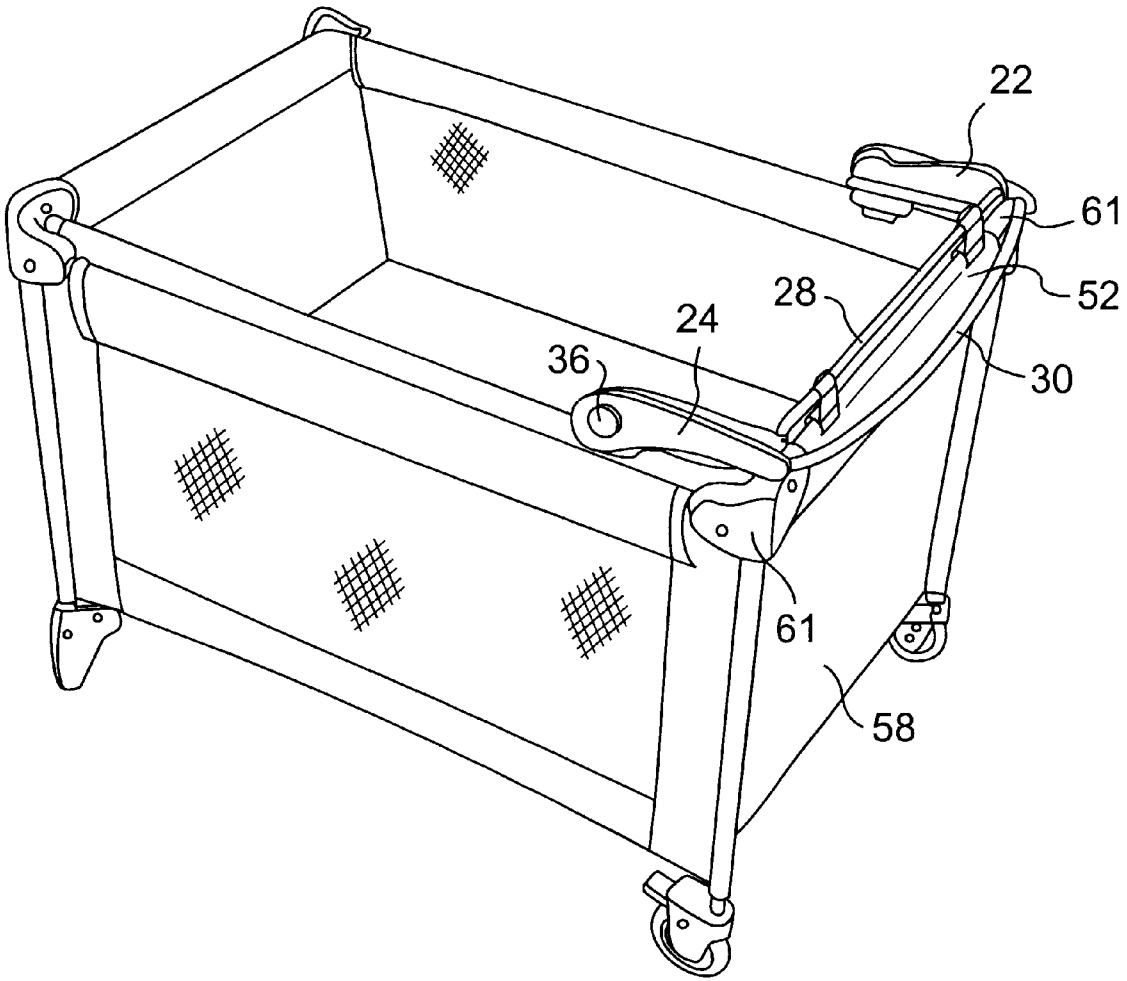
FIG. 3C is a perspective view of the apparatus in FIG. 3A with the changing table frame in a closed position.
Figure 8:
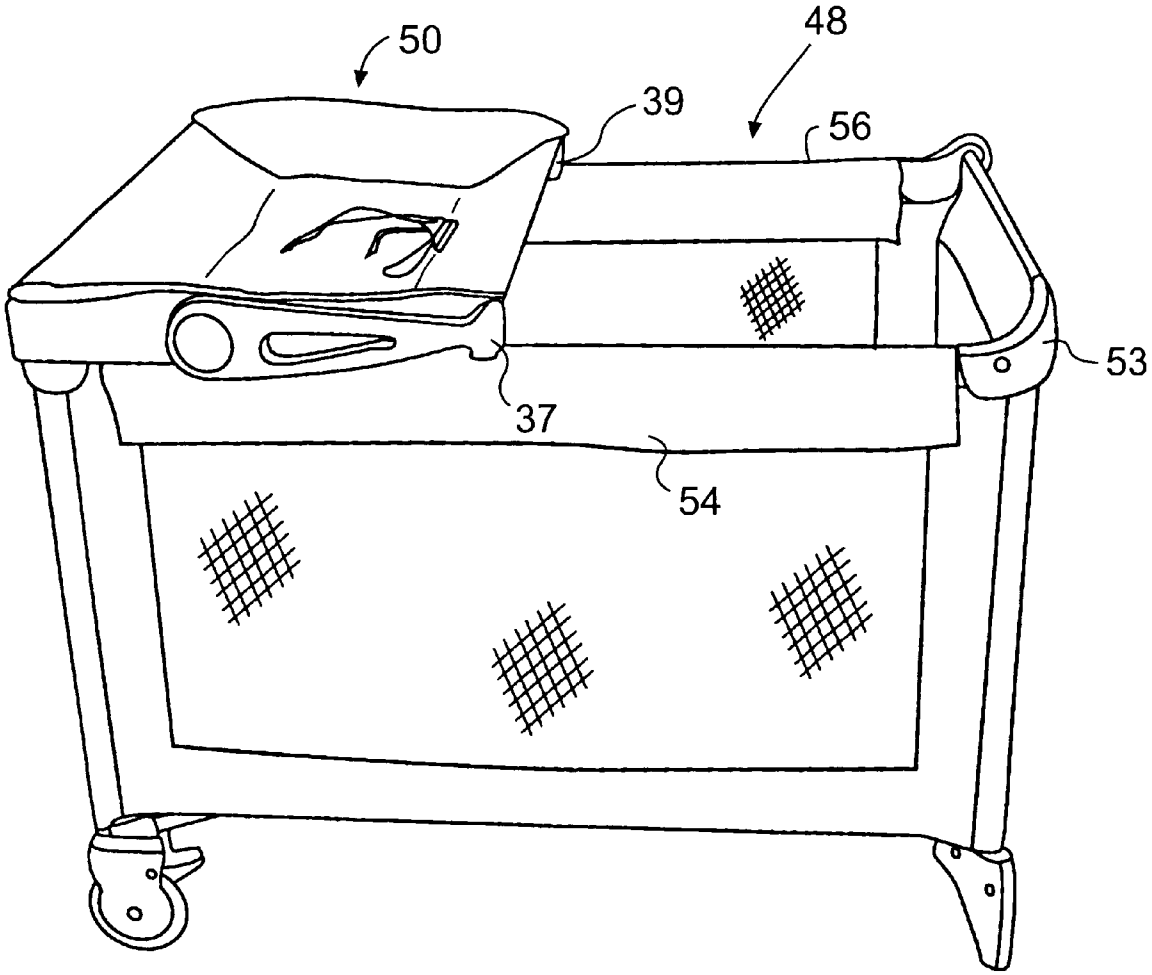
FIG. 8 is a perspective view of a playard with a changing table according to another preferred embodiment of the present invention.

FIGS. 3A to 3C show the progression of the changing table 50 being moved from the open position to the closed position while attached to the playard 48. In FIG. 3A, the changing table 50 is in the open position. The folding arms 24, 26 are arranged over their respective side rails 54, 56, and the second rail 30 is positioned away from the first rail 28 and the end rail member 52. The pivot arms 20, 22 can be attached to the side rails 54, 56 via brackets 34, 35, respectively, to support the arm assemblies 60, 62 while the changing table is in the open and closed positions, or in an intermediate position between the open and closed positions. Likewise, the folding arms 24, 26 can rest on top of the side rail members 54, 56 via end brackets 37, 39, if present, (as seen in the embodiments of FIGS. 8 and 9) while the changing table 50 is in the open position. The folding arms 24, 26 alternatively can be supported in place by the pivot joint 36, 38 via brackets 34, 35 or can be held in place by tension in the platform 40 between first rail 28 and second rail 30.

FIG. 3B shows the changing table 50 in an intermediate position between the open position and closed positions. In this position, the folding arms 24, 26 and the second rail 30 are raised and moved closer toward the first rail 28 and the end rail member 52. In this position, the changing table 50 is in a partially open position so that a part of the table surface (i.e., the platform 40) is available for storage while more of the playard 48 is available for use.

FIG. 3C shows the changing table 50 in its closed position. In the closed position, the folding arms 24, 26 extend toward the first rail 28 and the end rail member 52. The folding arms 24, 26 need not be, but can be, partially supported by the corner brackets 61 or the end rail member 52 of the playard in the closed position. In addition, the folding arms 24, 26 can be held in place by a locking mechanism (not shown) that locks pivot joints 36, 38, so that, for example, a baby positioned inside the playard is not able to move or displace the changing table 50 when it is in the closed position.

To open the changing table 50, the user can lift the second rail 30 and pivot it away from the first rail 28 until outer ends 24A, 26A of the folding arms 24, 26 are positioned over the side rail members 54, 56, respectively, and the flexible platform 40 is stretched between the first rail 28 and the second rail 30, as best seen in FIG. 1. To fold the changing table 50, the user reverses the above steps and pivots the second rail 30 toward the first rail 28 (and the end rail member 52) so that the platform 40 folds into its stored position, for example, as seen in FIG. 4.

Figure 6A:
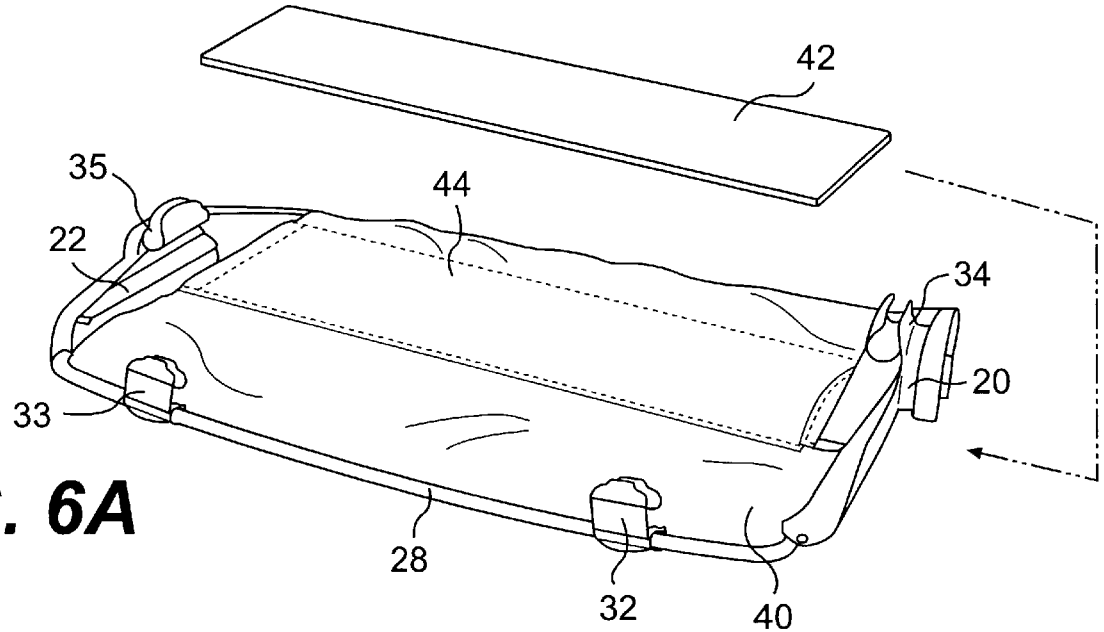
FIG. 6A is an exploded, partial, bottom perspective view of the changing table with the platform attached and showing a pouch in the platform.
Figure 6B:
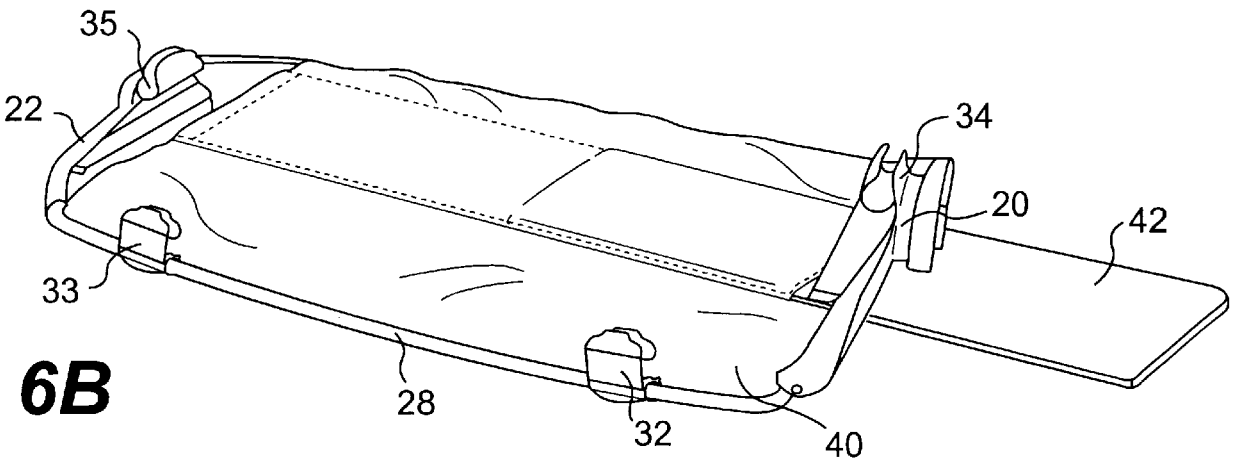
FIG. 6B is a partial, bottom perspective view of the apparatus in FIG. 6A with a board partially inserted in the pouch.
Figure 7:
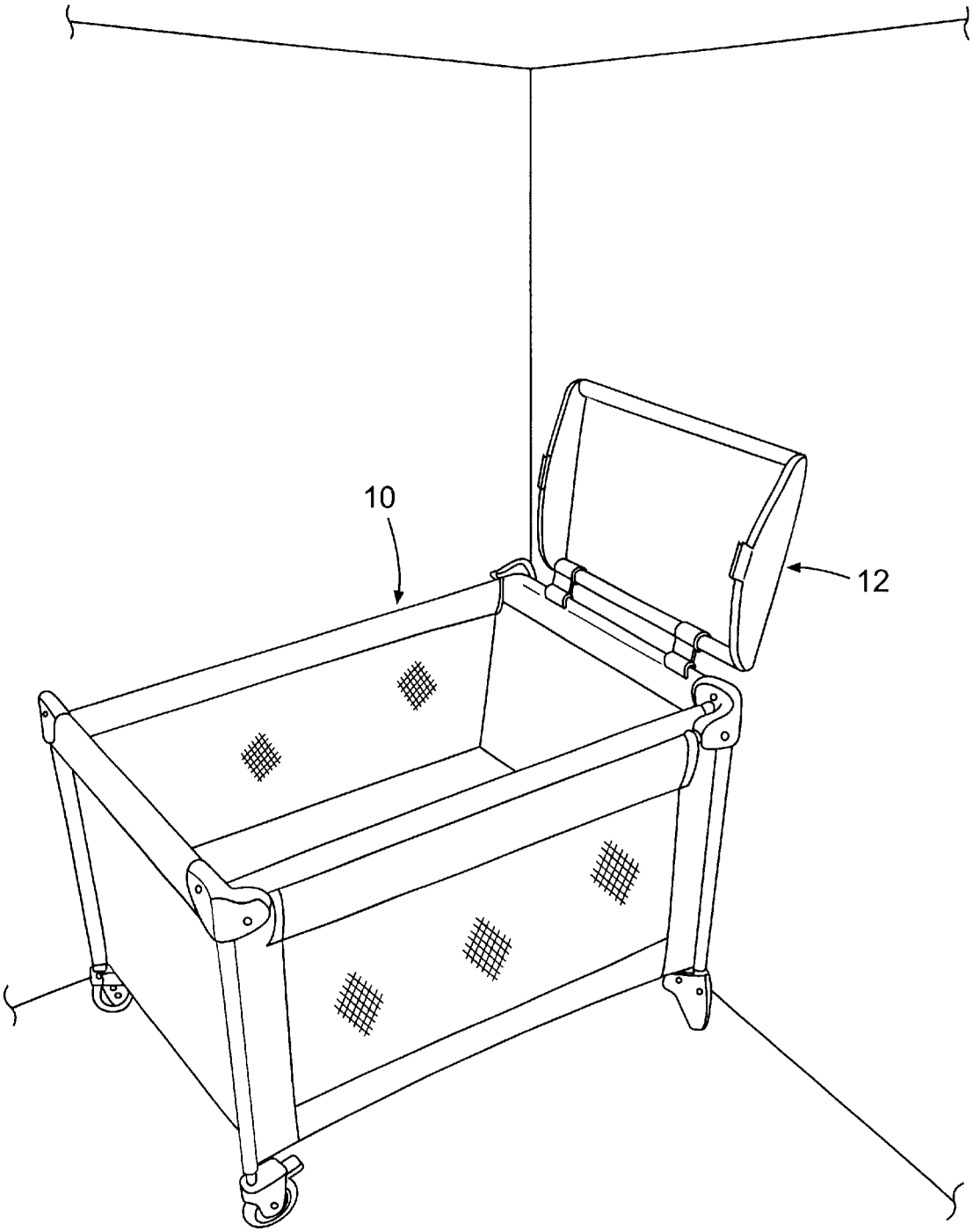
FIG. 7 PRIOR ART
FIG. 7 is a perspective view showing a conventional changing table attached to a conventional playard.

With reference to FIGS. 6A and 6B, the bottom side of the platform 40 can contain a pouch 44 in which a removable board 42 can be inserted for providing additional firmness to the changing table 50. The board 42 can be made of a stiff material and, in the illustrated embodiment, is rectangular in shape and extends substantially across the width of flexible platform 40. However, alternative shapes and sizes would be apparent to one skilled in the art, and all such shapes and sizes are within the scope of the present invention.

According to the present invention, the changing table advantageously does not require much clearance from the side of the playard during the folding process, and, in the folded position, the changing table occupies little space and extends only slightly outward from the end frame side 58 of the playard. Moreover, the changing table can be easily and safely folded over the side of the playard to a closed position, where it does not interfere with a child inside the playard.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A changing table for a playard, comprising:

a first arm assembly having a first pivot arm and a first folding arm pivotally connected thereto;

a second arm assembly having a second pivot arm and a second folding arm pivotally connected thereto;

a first rail connected to the first and second pivot arms;

a second rail connected to the first and second folding arms; and a platform attached to the first rail and the second rail and extending therebetween, wherein the length of each folding arm is slightly greater than the length of the respective pivot arm, and wherein the first and second folding arms together with the second rail are movable between an open position in which the second rail is positioned away from the first rail and a closed position in which the second rail is positioned adjacent to the first rail.

2. The changing table according to claim 1, wherein the first folding arm is pivotally connected to the first pivot arm with a first pivot joint and the second folding arm is pivotally connected to the second pivot arm with a second pivot joint.

3. The changing table according to claim 2, further comprising a locking mechanism for locking at least one of the first and second pivot joints to lock the first and second folding arms in at least one of the open position, the closed position, and an intermediate position between the open and closed positions.

4. The changing table according to claim 1, wherein the platform is comprised of a flexible material.

5. The changing table according to claim 1, wherein the platform includes a pouch on a bottom surface thereof for receiving a removable board.

6. The changing table according to claim 1, wherein the platform is adapted to be positioned outside of the playard when the changing table is in the closed position.

7. The changing table according to claim 6, wherein the platform is adapted to drape over a rail member of the playard when the changing table is in the closed position.

8. The changing table according to claim 1, wherein the first and second pivot arms are substantially parallel to each other.

9. The changing table according to claim 1, wherein the first and second folding arms are substantially parallel to each other.

10. The changing table according to claim 1, wherein at least one of the first and second pivot arms is adapted to attach to a upper side rail member of the playard.

11. The changing table according to claim 10, further comprising a bracket for attaching the at least one of the first and second pivot arms to the upper side rail member of the playard.

12. The changing table according to claim 1, wherein the first rail is adapted to attach to an upper end rail member of the playard, and the first and second pivot arms are adapted for attaching to upper side rail members of the playard.

13. The changing table according to claim 12, further comprising a bracket for attaching the first rail to the upper end rail member of the playard.

14. The changing table according to claim 1, wherein the folding arms are adapted to lie substantially over upper side rail members of the playard when the folding table is in the open position.

15. The changing table according to claim 1, wherein the second rail extends beyond an end of the playard when the folding table is in the closed position.

16. A playard comprising:

an upper end rail member and a pair of upper side rail members; and a changing table connected at least to one of the pair of the upper side rail members, the changing table comprising:

a first arm assembly having a first pivot arm and a first folding arm pivotally connected thereto;

a second arm assembly having a second pivot arm and a second folding arm pivotally connected thereto; and a first rail connected to the first and second pivot arms;

a second rail connected to the first and second folding arms, wherein the length of each folding arm is slightly greater than the length of the respective pivot arm, and wherein the changing table is movable between an open position in which the second rail is positioned away from the first rail and a closed position in which the second rail is positioned adjacent to the first rail.

17. The playard according to claim 16, wherein the first folding arm is pivotally connected to the first pivot arm with a first pivot joint, and the second folding arm is pivotally connected to the second pivot arm with a second pivot joint.

18. The playard according to 17, further comprising a locking mechanism for locking at least one of the first and second pivot joints to lock the first and second folding arms in at least one of the open position, the closed position, and an intermediate position between the open and closed positions.

19. The playard according to claim 16, further including a platform attached to the first rail and the second rail.

20. The playard according to claim 19, wherein the platform is comprised of a flexible material.

21. The playard according to claim 19, wherein the platform includes a pouch on a bottom surface thereof for receiving a removable board.

22. The playard according to claim 19, wherein the platform is positioned outside of the playard when the changing table is in the closed position.

23. The playard according to claim 10, wherein the platform drapes over the upper end rail member when the changing table is in the closed position.

24. The playard according to claim 16, wherein the first and second pivot arms are attached to the pair of upper side rail members, respectively.

25. The playard according to claim 16, further including a bracket for attaching one of the first or second pivot arms to one of the pair of the upper side rail members.

26. The playard according to claim 16, wherein the first and second folding arms lie substantially over the upper side rail members when the folding table is in the open position.

27. A changing table for a playard, comprising:

a first arm assembly having a first pivot arm and a first folding arm connected thereto about a first pivot;

a second arm assembly having a second pivot arm and a second folding arm connected thereto about a second pivot;

a first rail connected to the first and second pivot arms;

a second rail connected to the first and second folding arms; and a platform attached to the first rail and the second rail and extending therebetween, wherein, while the first and second arm assemblies are mounted to the playard, the first and second folding arms together with the second rail are movable about the first and second pivots between an open position in which the platform is open for receipt of a child and a closed position in which the platform is draped outside the playard.

* * * * *